US008976071B1

(12) United States Patent
Doane et al.

(10) Patent No.: US 8,976,071 B1
(45) Date of Patent: Mar. 10, 2015

(54) INTEGRATED L/C/KU BAND ANTENNA WITH OMNI-DIRECTIONAL COVERAGE

(71) Applicants: Jonathan P. Doane, Columbus, OH (US); Brian J. Herting, Marion, IA (US); Lee M. Paulsen, Cedar Rapids, IA (US); Jeremiah D. Wolf, Marion, IA (US); Wajih A. ElSallal, Acton, MA (US)

(72) Inventors: Jonathan P. Doane, Columbus, OH (US); Brian J. Herting, Marion, IA (US); Lee M. Paulsen, Cedar Rapids, IA (US); Jeremiah D. Wolf, Marion, IA (US); Wajih A. ElSallal, Acton, MA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 13/892,760

(22) Filed: May 13, 2013

Related U.S. Application Data

(62) Division of application No. 12/383,099, filed on Mar. 19, 2009, now Pat. No. 8,466,843.

(51) Int. Cl.
*H01Q 21/00* (2006.01)
*H01Q 21/30* (2006.01)

(52) U.S. Cl.
CPC ..... *H01Q 21/30* (2013.01)
USPC ..... 343/725

(58) Field of Classification Search
USPC ..... 343/725
See application file for complete search history.

(56) References Cited

U.S. PATENT DOCUMENTS

| | | | | |
|---|---|---|---|---|
| 3,445,849 | A * | 5/1969 | Sanford | 343/702 |
| 3,449,749 | A * | 6/1969 | McEvoy | 342/444 |
| 6,160,512 | A * | 12/2000 | Desclos et al. | 343/700 MS |
| 6,388,622 | B1 * | 5/2002 | Jennetti et al. | 343/700 MS |
| 6,806,838 | B2 * | 10/2004 | Petros et al. | 343/725 |
| 7,110,762 | B1 * | 9/2006 | Cameron et al. | 455/434 |
| 2004/0233120 | A1 * | 11/2004 | Ryan | 343/878 |
| 2008/0062062 | A1 * | 3/2008 | Borau et al. | 343/844 |
| 2008/0094299 | A1 * | 4/2008 | Williams | 343/836 |

OTHER PUBLICATIONS

"Antenna Frequency Scaling," The ARRL Antenna Book, 1988, pp. 2-24 to 2-25.*

"USAF ARL launches mini common datalink project for small UAVs," http://www.flightglobal.com/news/articles/usaf-afrl-launches-mini-common-datalink-project-for-small-208667/, Aug. 25, 2006.*

* cited by examiner

*Primary Examiner* — Graham Smith
(74) *Attorney, Agent, or Firm* — Angel N. Gerdzhikov; Donna P. Suchy; Daniel M. Barbieri

(57) ABSTRACT

An integrated antenna system is disclosed which may include a first antenna sub-system. The integrated antenna system may further include a second antenna sub-system. The first antenna sub-system may be a Ku-band antenna sub-system. The second antenna sub-system may be one of: an L-band antenna sub-system or a C-band antenna sub-system. The second antenna sub-system may be tightly/seamlessly integrated with the first antenna sub-system, thereby providing a system with integrated antenna bands which provides omni-directional coverage.

11 Claims, 2 Drawing Sheets

INTEGRATED L/C/KU BAND ANTENNA WITH OMNI-DIRECTIONAL COVERAGE

CROSS REFERENCE TO RELATED APPLICATIONS

The present application is a divisional application and claims priority under 35 U.S.C. §120 to U.S. patent application Ser. No. 12/383,099 filed Mar. 19, 2009. The U.S. patent application Ser. No. 12/383,099 filed Mar. 19, 2009 is hereby incorporated by reference.

FIELD OF THE INVENTION

The present invention relates to the field of Radio Frequency (RF) devices (ex.—antenna technology) and Advanced Radio Systems and particularly to a system for providing an integrated L/C/Ku band antenna with omni-directional coverage.

BACKGROUND OF THE INVENTION

A number of current RF devices (ex.—antennas) may not perform to a desired level.

Thus, it would be desirable to provide a system for providing an antenna which obviates the problems associated with current antennas.

SUMMARY OF THE INVENTION

Accordingly, an embodiment of the present invention is directed to an antenna system, including: a first antenna sub-system, the first antenna sub-system being a Ku-band antenna sub-system; and a second antenna sub-system, the second antenna sub-system being one of: an L-band antenna sub-system and a C-band antenna sub-system, wherein the second antenna sub-system is integrated with the first antenna sub-system and said antenna system provides omni-directional coverage/provides an omni-direction radiation pattern.

An additional embodiment of the present invention is directed to an antenna system, including: a Ku-band antenna sub-system, the Ku-band antenna sub-system including a diplexer and a Ku-band antenna, said Ku-band antenna configured for being mounted upon said diplexer, said Ku-band antenna including an antenna body portion and a Ku-band feed network, said antenna body portion including a plurality of radiating surfaces, said Ku-band feed network including a Ku-band feed board configured for providing a feed to the Ku-band antenna; and an L-band antenna sub-system, the L-band antenna sub-system including a plurality of L-band monopoles and a planar support, said Ku-band antenna sub-system and said plurality of L-band monopoles being configured for being mounted upon said planar support, said planar support configured for serving as a local, L-band ground plane and an L-band feed plane for the plurality of L-band monopoles, wherein said L-band antenna sub-system is integrated with said Ku-band antenna sub-system.

A further embodiment of the present invention is directed to an antenna system, including: a Ku-band antenna sub-system, the Ku-band antenna sub-system including a Ku-band diplexer and a Ku-band antenna, said Ku-band antenna configured for being mounted upon said Ku-band diplexer, said Ku-band antenna including a Ku-band antenna body portion and a Ku-band feed network, said Ku-band antenna body portion including a plurality of Ku-band radiating surfaces and a support surface, said Ku-band feed network including a Ku-band feed board configured for providing a feed to the Ku-band antenna; and a C-band antenna sub-system, the C-band antenna sub-system including a C-band monopole and a C-band feed, said C-band monopole configured for being at least partially mounted upon said support surface of said Ku-band antenna body portion, said support surface of said Ku-band antenna body portion serving as a C-band ground plane for the C-band monopole, said C-band feed configured for being connected to the C-band monopole, wherein said C-band antenna sub-system is integrated with said Ku-band antenna sub-system.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
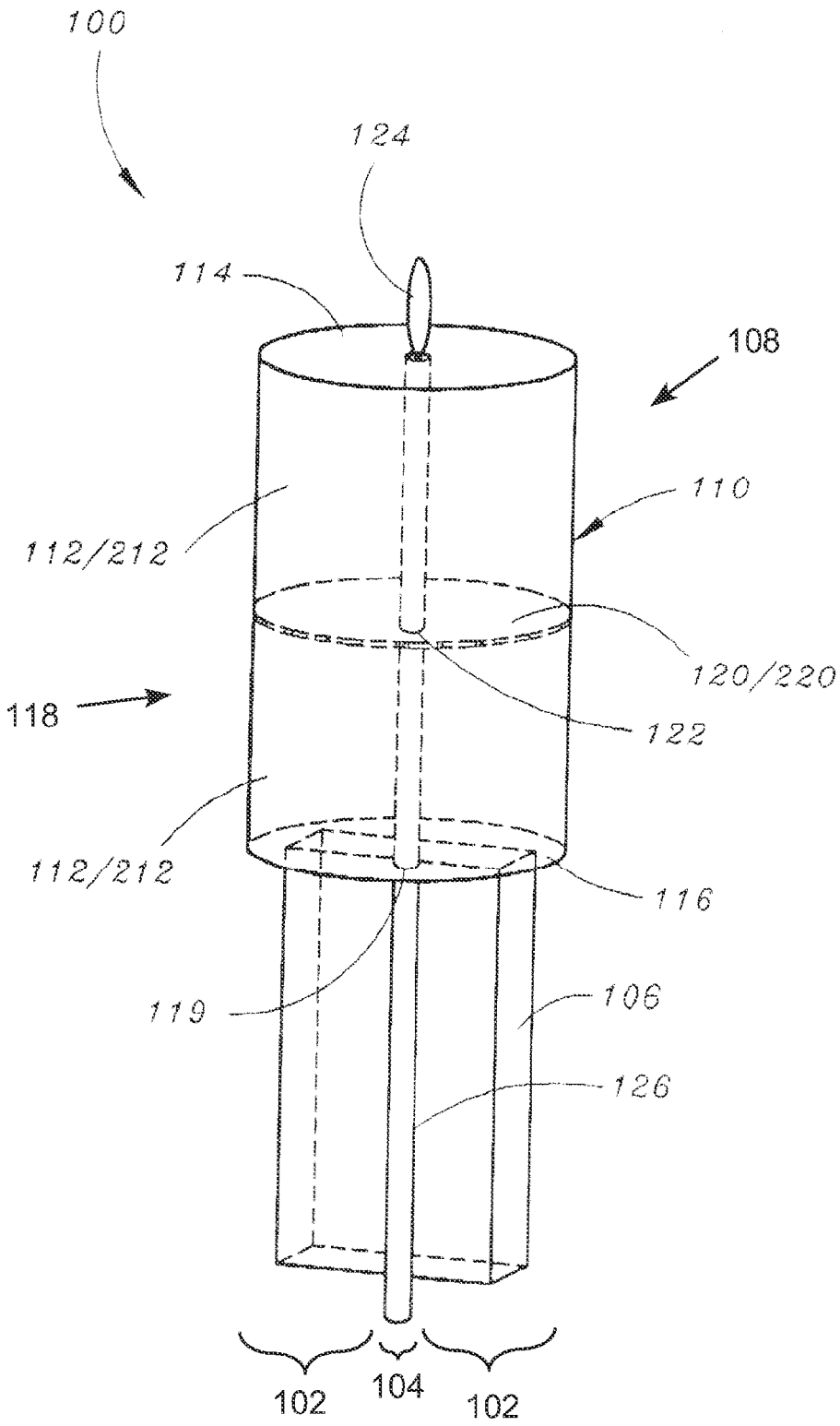
FIG. 1 is a cutaway view of an antenna system in which a C-band antenna sub-system is integrated with a Ku-band antenna sub-system in accordance with an exemplary embodiment of the present invention.
Figure 2:
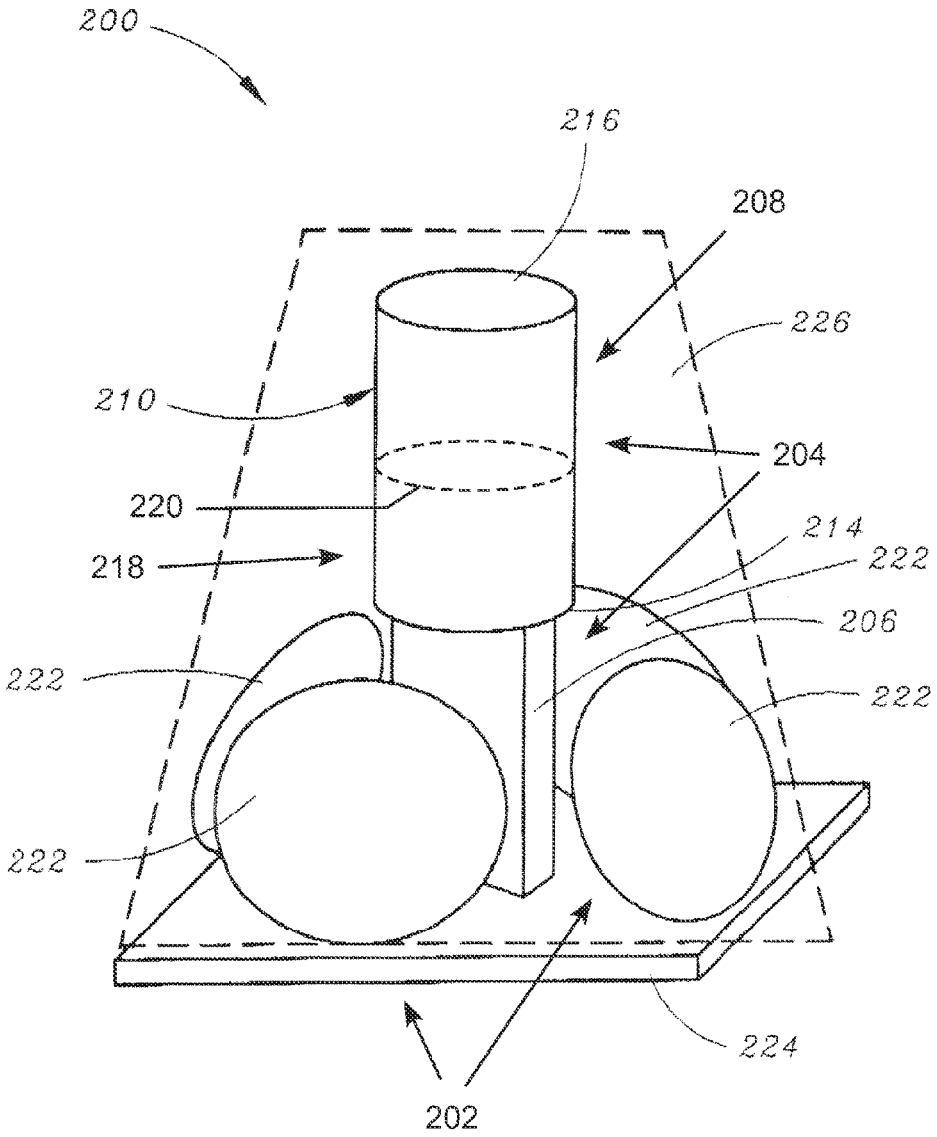
FIG. 2 is an isometric view of an antenna system in which an L-band antenna sub-system is integrated with a Ku-band antenna sub-system in accordance with an alternative exemplary embodiment of the present invention.

Referring to FIGS. 1 and 2, antenna systems in accordance with exemplary embodiments of the present invention are shown. FIG. 1 illustrates an antenna system 100, in accordance with a first exemplary embodiment of the present invention. In the illustrated embodiment, the antenna system 100 may include a first antenna sub-system 102. For example, the first antenna sub-system 102 may be a Ku-band antenna sub-system/Ku-band array. Further, the antenna system 100 may include a second antenna sub-system 104. For instance, the second antenna sub-system 104 may be a C-band antenna sub-system/C-band antenna.

In a current embodiment of the present invention, the Ku-band antenna sub-system 102 may include a diplexer 106 (ex.—a Ku-band diplexer). In an exemplary embodiment, the diplexer 106 may be formed of metal/may be metallic. In a further embodiment, the diplexer may be two inches (2") tall by 1" by 0.5".

In an exemplary embodiment of the present invention, the Ku-band antenna sub-system 102 may further include an antenna 108 (ex.—a Ku-band antenna). The Ku-band antenna 108 may be configured for being mounted upon the Ku-band diplexer 106. In further embodiments of the present invention, the Ku-band antenna 108 may include a Ku-band antenna body portion 110. The Ku-band antenna body portion 110 may form/may include a plurality of radiating surfaces 112 (ex.—Ku-band radiating surfaces). Further, the Ku-band antenna body portion 110 may include a support surface 114. For instance, the Ku-band antenna body portion 110 may be cylindrically-shaped/may form an antenna cylinder/may form a cylindrically-shaped enclosure (as shown in FIG. 1), having an outer wall (ex—includes the radiating surfaces 112), a first end/bottom end/bottom surface 116 (ex.—which may be supported upon/mounted upon the diplexer 106), and a second end/top end/upper surface (ex.—the support surface 114, which may be oriented away from the diplexer 106).

In current embodiments of the present invention, the Ku-band antenna 108 may further include a feed network 118 (ex.—a Ku-band feed network). In exemplary embodiments of the present invention, the Ku-band feed network 118 may include a feed board 120 (ex.—a Ku-band feed board). The Ku-band feed board 120 may be configured for providing a feed to the Ku-band antenna 108. Further, the Ku-band feed board 120 may form an aperture 122 (ex—may include a surface which forms an aperture/may have an aperture formed therethrough), as shown in FIG. 1. In further embodiments, the Ku-band feed board 120 may be configured for being disposed at least substantially within/for being at least substantially contained within the Ku-band antenna body portion 110.

As mentioned above, in exemplary embodiments, the second antenna sub-system 104 may be a C-band antenna sub-system/C-band antenna. The C-band antenna sub-system 104 may include a C-band monopole/C-band element 124. For example, the C-band monopole/C-band element 124 may be a wideband C-band monopole/wideband C-band element. The C-band monopole 124 is configured for being at least partially upon the support surface 114 of the Ku-band antenna body portion 110. Further, the support surface 114 of the Ku-band antenna body portion 110 is configured for serving as/providing a ground plane (ex.—a C-band ground plane) for the C-band monopole 124.

In current embodiments of the present invention, the C-band antenna sub-system 104 may further include a C-band feed 126. The C-band feed 126 may be configured for being connected to the C-band monopole 124. For example, the C-band feed 126 may be a coaxial feed which is configured for being routed through the bottom surface 116 (ex.—via an aperture 119 formed by/formed through the bottom surface 116) of the Ku-band antenna body portion 110 and through the aperture 122 of the Ku-band feed board 120 to the C-band monopole 124.

In exemplary embodiments of the present invention, the C-band monopole 124 may be configured for providing an omni-directional radiation pattern/may be omni-directional/may produce an omni pattern/may provide omni-directional radiation. Further, the C-band monopole 124 is configured for providing a wideband response. For example, the C-band antenna sub-system 104 may be integrated with the Ku-band antenna sub-system 102/seamlessly integrated with the Ku-band antenna sub-system 102/tightly integrated on top of the Ku-band antenna sub-system/Ku-band array 102. Further, the C-band monopole 124 may be shaped for covering 5-7 GHz. The shape and feed configuration of the C-band monopole 124 may determine its frequency response and bandwidth.

FIG. 2 illustrates an antenna system 200, in accordance with a second exemplary embodiment of the present invention. In the illustrated embodiment, the antenna system 200 may include a first antenna sub-system 202. For example, the first antenna sub-system 202 may be a Ku-band antenna sub-system/Ku-band array. Further, the antenna system 200 may include a second antenna sub-system 204. For instance, the second antenna sub-system 204 may be an L-band antenna sub-system/L-band antenna/L-band array.

In a current embodiment of the present invention, the Ku-band antenna sub-system 202 may include a diplexer 206 (ex.—a Ku-band diplexer). In an exemplary embodiment, the diplexer 206 may be formed of metal/may be metallic. In a further embodiment, the diplexer may be two inches (2") tall by 1" by 0.5".

In an exemplary embodiment of the present invention, the Ku-band antenna sub-system 202 may further include an antenna 208 (ex.—a Ku-band antenna). The Ku-band antenna 208 may be configured for being mounted upon the Ku-band diplexer 206. In further embodiments of the present invention, the Ku-band antenna 208 may include a Ku-band antenna body portion 210. The Ku-band antenna body portion 210 may form/may include a plurality of radiating surfaces 212 (ex.—Ku-band radiating surfaces). Further, the Ku-band antenna body portion 210 may be cylindrically-shaped/may form an antenna cylinder/may form a cylindrically-shaped enclosure, having an outer wall (ex—includes the radiating surfaces 212), a first end/bottom end/bottom surface 214 (ex.—which may be supported upon/mounted upon the diplexer 206), and a second end/top end/upper surface 216 (ex.—which may be oriented away from the diplexer 206).

In current embodiments of the present invention, the Ku-band antenna 108 may further include a feed network 218 (ex.—a Ku-band feed network). In exemplary embodiments of the present invention, the Ku-band feed network 218 may include a feed board 220 (ex.—a Ku-band feed board). The Ku-band feed board 220 may be configured for providing a feed to the Ku-band antenna 208. In further embodiments, the Ku-band feed board 220 may be configured for being disposed at least substantially within/for being at least substantially contained within the Ku-band antenna body portion 210.

As mentioned above, in exemplary embodiments, the second antenna sub-system 204 may be an L-band antenna sub-system/L-band antenna/L-band array. In exemplary embodiments of the present invention, the L-band antenna sub-system 204 may include a plurality of monopoles/elements 222 (ex.—L-band monopoles/L-band elements). Further, the second antenna sub-system 204 may include a planar support 224. In current embodiments of the present invention, the Ku-band antenna sub-system 202 and the plurality of L-band monopoles 222 may be configured for being mounted upon the planar support 224. Further, the planar support 224 may be configured for serving as/providing a local, L-band ground plane for the plurality of L-band monopoles 222. Still further, the planar support 224 may be configured for serving as/providing an L-band feed plane/horizontal feed network for the plurality of L-band monopoles.

In exemplary embodiments, as shown in FIG. 2, the diplexer 206 may be/may form a post (ex.—a central post) which may be configured for being centrally-positioned/generally centrally-positioned on said planar support 224. Further, the plurality of L-band monopoles 222 may be shaped monopoles, such as four (4) L-band wideband monopoles/L-band elements, which may be mounted upon the planar support 224 and configured/distributed/positioned/spaced (at least partially) around the central post/diplexer 206, such as in a circular or cylindrical arrangement/array (as shown in FIG. 2).

In current embodiments of the present invention, the plurality of L-band monopoles 222 may be configured for providing an omni-directional radiation pattern/may be omni-directional/may produce an omni pattern/may provide omni-directional radiation. Further, the plurality of L-band monopoles 222 is configured for providing a wideband response (ex.—1350 Megahertz to 1850 Megahertz). Still further, the L-band antenna sub-system 204 may be integrated with the Ku-band antenna sub-system 202/seamlessly integrated with the Ku-band antenna sub-system 202/tightly integrated around the Ku-band antenna sub-system/Ku-band array 202.

In exemplary embodiments of the present invention, the antenna system 200 may further include a radome 226 (ex.—a Ku-band radome). The radome 226 may be configured for at least substantially enclosing the Ku-band antenna 208 and the plurality of L-band monopoles 222. In current embodiments of the present invention, the plurality of L-band monopoles 222 may by conformal with the Ku-band radome 226 for minimal Size Weight and Power (SWAP) impact.

The antenna system embodiments 100, 200 of the present invention may be implemented as part of/with a mini-Common Data Link (mini-CDL) antenna system, a Quint Networking Technology (QNT) system, a rover system, etc., since integrated antenna bands/integrated hardware of said antenna system embodiments of the present invention support said mini-CDL, QNT and rover systems.

The antenna system embodiments 100, 200 of the present invention allow for seamless integration of either a C-band antenna system/sub-system or an L-band antenna system/sub-system with a Ku-band antenna system/sub-system, thereby obviating any need to have separate antenna installations for separate bands.

In exemplary embodiments of the present invention, Ku-band may be defined as a portion of the electromagnetic spectrum in the microwave range of frequencies ranging from at least approximately eleven to eighteen Gigahertz (11 GHz-18 GHz). In further embodiments of the present invention, C-band may be defined as a portion of the electromagnetic spectrum in the microwave range of frequencies ranging from at least approximately three to eight Gigahertz (3 GHz-8 GHz). In still further embodiments of the present invention, L-band may be defined as a portion of the electromagnetic spectrum in the microwave range of frequencies ranging from at least approximately 0.8 GHz to 2.0 GHz.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna system, comprising:

a first antenna sub-system, the first antenna sub-system being a Ku-band antenna sub-system, said Ku-band antenna sub-system including a Ku-band diplexer and a Ku-band antenna, said Ku-band diplexer being formed of a metal having dimensions of about two inches by one inch by one-half inch, said Ku-band antenna configured for being mounted upon said Ku-band diplexer, said Ku-band antenna including a Ku-band antenna body portion and a Ku-band feed network, said Ku-band antenna body portion being cylindrically-shaped, said Ku-band antenna body portion including a plurality of Ku-band radiating surfaces, a bottom surface, and a support surface, said bottom surface forming a bottom surface aperture, said Ku-band feed network including a Ku-band feed board configured for providing a feed to the Ku-band antenna, said Ku-band feed board forming an aperture; and a second antenna sub-system, the second antenna sub-system being a C-band antenna sub-system, the C-band antenna sub-system including a C-band monopole and a C-band feed, said C-band monopole configured for being at least partially mounted upon said support surface of said Ku-band antenna body portion, said support surface of said Ku-band antenna body portion serving as a C-band ground plane for the C-band monopole, said C-band feed configured for being connected to the C-band antenna, said C-band feed further configured for being routed through the Ku-band antenna body portion, through the bottom surface aperture of said bottom surface, and through said aperture of said Ku-band feed board to the C-band monopole, wherein the second antenna sub-system is integrated with the first antenna sub-system and said antenna system provides omni-directional coverage.

2. An antenna system, comprising:

a Ku-band antenna sub-system, the Ku-band antenna sub-system including a Ku-band diplexer and a Ku-band antenna, said Ku-band diplexer being formed of a metal having dimensions of about two inches by one inch by one-half inch, said Ku-band antenna configured for being mounted upon said Ku-band diplexer, said Ku-band antenna including a Ku-band antenna body portion and a Ku-band feed network, said Ku-band antenna body portion including a plurality of Ku-band radiating surfaces, and a support surface, said Ku-band feed network including a Ku-band feed board configured for providing a feed to the Ku-band antenna; and a C-band antenna sub-system, the C-band antenna sub-system including a C-band monopole and a C-band feed, said C-band monopole configured for being at least partially mounted upon said support surface of said Ku-band antenna body portion, said support surface of said Ku-band antenna body portion serving as a C-band ground plane for the C-band monopole, said C-band feed configured for being connected to the C-band monopole, wherein said C-band antenna sub-system is integrated with said Ku-band antenna sub-system.

3. An antenna system as claimed in claim 2, wherein said C-band feed is further configured for being routed through the Ku-band antenna body portion, through an aperture formed by said Ku-band feed board, then to the C-band monopole.

4. An antenna system as claimed in claim 2, wherein said Ku-band feed board is configured for being disposed at least substantially within said Ku-band antenna body portion.

5. An antenna system as claimed in claim 2, wherein said Ku-band antenna body portion is cylindrically-shaped.

6. An antenna system as claimed in claim 2, wherein said C-band monopole is configured for providing an omni-directional radiation pattern.

7. An antenna system as claimed in claim 2, wherein said C-band monopole is configured for providing a wideband response, said response being a value included in a range of values ranging from 5 Gigahertz to 7 Gigahertz.

8. An antenna system as claimed in claim 2, wherein said C-band feed is a coaxial feed.

9. The antenna system as claimed in claim 1, wherein the antenna system is implemented as part of or with at least one of a Quint Networking Technology (QNT) system and a rover system.

10. The antenna system as claimed in claim 1, wherein integration of C-band antenna sub-system and said Ku-band antenna sub-system includes integration of the hardware and antenna bands.

11. The antenna system as claimed in claim 1, wherein said C-band feed is further configured for being orthogonally routed through the Ku-band antenna body portion and through said aperture of said Ku-band feed board to the C-band monopole.

* * * * *